US006598764B1

(12) United States Patent
Stern

(10) Patent No.: US 6,598,764 B1
(45) Date of Patent: Jul. 29, 2003

(54) DEVICE FOR DISCHARGE OF A PASTE-LIKE PRODUCT FROM A PACKAGE OF FLEXIBLE MATERIAL AND PACKAGE ADAPTED FOR USE IN CONNECTION WITH SAID DEVICE

(76) Inventor: Leif Einar Stern, Strandvägen 164, Lomma (SE), S-234 32

( * ) Notice: Subject to any disclaimer, the term of this patent is extended or adjusted under 35 U.S.C. 154(b) by 0 days.

(21) Appl. No.: 09/913,982

(22) PCT Filed: Mar. 2, 2000

(86) PCT No.: PCT/SE00/00409

§ 371 (c)(1),
(2), (4) Date: Aug. 21, 2001

(87) PCT Pub. No.: WO00/53512

PCT Pub. Date: Sep. 14, 2000

(30) Foreign Application Priority Data

Mar. 5, 1999 (SE) ..... 9900780

(51) Int. Cl.[7] ..... B65D 35/28

(52) U.S. Cl. ..... 222/95; 222/105; 222/327; 222/391

(58) Field of Search ..... 222/95, 98, 99, 222/100, 101, 105, 391, 386, 325, 326, 327

(56) References Cited

U.S. PATENT DOCUMENTS

| | | | | | |
|---|---|---|---|---|---|
| 2,037,989 | A | * | 4/1936 | Macklanburg | 206/56 |
| 2,115,591 | A | * | 4/1938 | Sherbondy | 18/3.5 |
| 3,288,333 | A | * | 11/1966 | Valk, Jr. | 222/95 |
| 3,323,682 | A | * | 6/1967 | Creighton, Jr. et al. | 222/94 |
| 3,687,339 | A | * | 8/1972 | Dessureault | 222/183 |
| 3,884,396 | A | * | 5/1975 | Gordon et al. | 222/327 |
| 4,126,251 | A | * | 11/1978 | Subwick | 222/326 |
| 4,323,176 | A | * | 4/1982 | Sartain | 222/326 |
| 4,356,938 | A | * | 11/1982 | Kayser | 222/327 |
| 5,156,305 | A | * | 10/1992 | Eyre | 222/327 |
| 5,323,931 | A | * | 6/1994 | Robards, Jr. et al. | 222/96 |
| 5,370,282 | A | * | 12/1994 | Sedlmeier | 222/391 |
| 5,375,740 | A | | 12/1994 | Umetsu et al. | |
| 5,443,181 | A | * | 8/1995 | Popp et al. | 222/95 |
| 5,501,374 | A | * | 3/1996 | Laufer et al. | 222/391 |
| 5,650,180 | A | * | 7/1997 | Kumada et al. | 425/376.1 |
| 5,893,488 | A | * | 4/1999 | Hoag et al. | 222/391 |
| 6,325,249 | B1 | * | 12/2001 | Keller | 222/137 |
| 6,386,401 | B1 | * | 5/2002 | Dodd et al. | 222/391 |

FOREIGN PATENT DOCUMENTS

| | | | | |
|---|---|---|---|---|
| CH | 669165 | | 2/1989 | |
| GB | 2088998 A | * | 6/1982 | F16J/1/00 |
| WO | 9725155 | | 7/1997 | |

* cited by examiner

*Primary Examiner*—Henry C. Yuen
*Assistant Examiner*—Frederick C. Nicolas
(74) *Attorney, Agent, or Firm*—Tarolli, Sundheim, Covell & Tummino L.L.P.

(57) ABSTRACT

The present invention relates to a device for discharge of a paste-like product, e.g., mayonnaise or similar, from a package of flexible material, and a package for use with the device. The device includes an outer member (9) and an inner container (24) provided in the outer member (9) and in which the package (2) is located. The inner container (24) is displaceable in a discharge and in a return direction (M, R) together with the package (2). Front parts (29) of the package (2) engage a front end side (28) of the outer member (9) during discharge of the product (3) and are disengaged when the inner container (24) with the package (2) is displaced in the return direction (R), whereby the discharge pressure on the product (3) and thereby, the discharge thereof, ceases.

23 Claims, 10 Drawing Sheets

DEVICE FOR DISCHARGE OF A PASTE-LIKE PRODUCT FROM A PACKAGE OF FLEXIBLE MATERIAL AND PACKAGE ADAPTED FOR USE IN CONNECTION WITH SAID DEVICE

The present invention relates to a device for discharge of a paste-like, viscous, product, e.g. mayonnaise or similar, from a package of flexible material, wherein the discharge device comprises an outer member and an inner container provided in said outer member, said package with the product to be discharged being located in said inner container, wherein a feeding device is provided to displace the inner container with the package provided therein in a discharge direction to a front or forward position relative to the outer member, whereby, in said front or forward position, front parts of the package engage a front end side of the outer member, and wherein a piston means forming part of the feeding device is provided to compress the package and thereby increase the pressure on the product therein for discharge of said product when the front parts of the package in said front position engage the front end side of the outer member. The invention also relates to a package adapted for use in connection with said device.

Devices of the abovementioned type are known from e.g. U.S. Pat. No. 5,375,740 and are adapted for discharge of paste-like, viscous, products from expensive plastic containers.

These prior art devices however, are not suitable for discharge of paste-like products from simple plastic containers such as plastic bags.

The object of the present invention is to remedy this problem, which is done by providing the abovementioned device with substantially the characterizing features of subsequent claim 1.

A package adapted for use in connection with said device, has substantially the characterizing features of subsequent claim 12.

Since the device and/or the package have/has said characterizing features, it is possible to use a simple and cheap package such as a plastic bag and at the same time ensure that dripping after discharge is prevented and that discharge is possible until the package is completely empty.

The invention will be further described below with reference to the accompanying drawings, in which FIG. 1 is a perspective view of a discharge device according to the invention;

Figure 1:
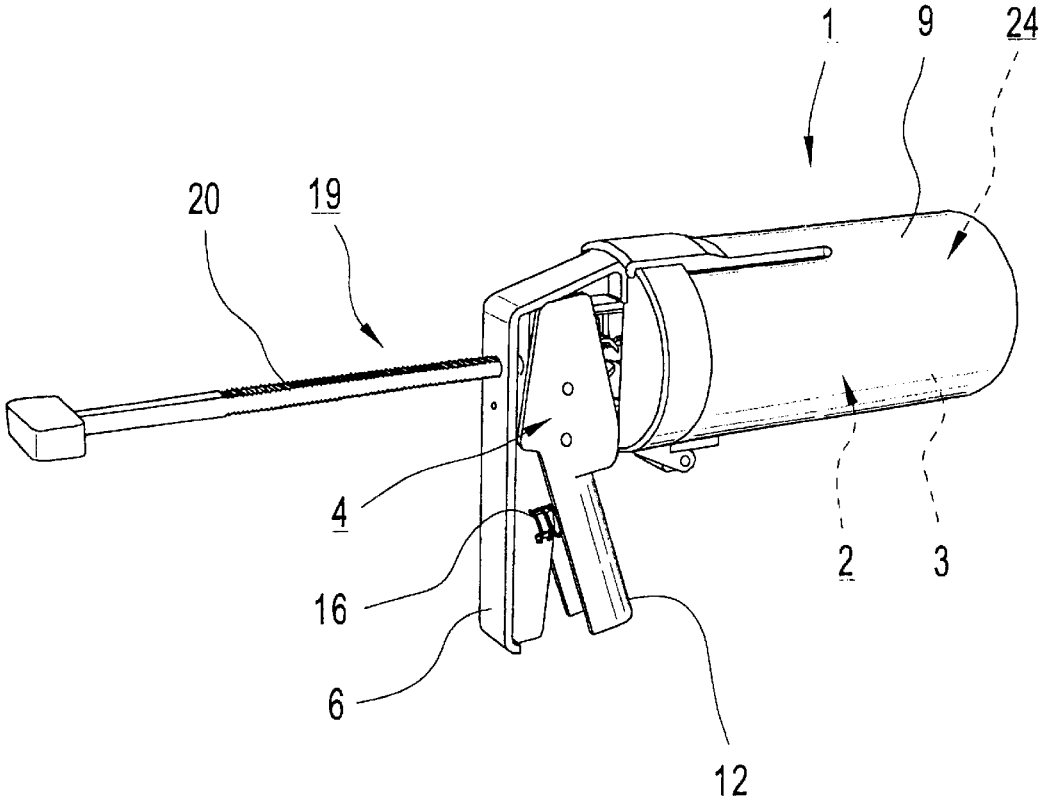

The discharge device 1 illustrated in the drawings has a gun-like design and is adapted to permit location therein of a package 2. The package 2 contains a paste-like, viscous, product 3, e.g. mayonnaise or similar foodstuff, and this product is discharged by means of a step feeding device 4 of a type known per se.

The gun-like discharge device 1 includes a body 5 which at the rear has a downwardly directed handle member 6 and which at the front/down below has bearing members 7 for an axle 8 on which an outer member 9 is pivotally mounted such that it can pivot downwards (see arrow A, FIG. 2) relative to the body 5 to a position at which a rear opening 10 thereof is exposed. The outer member 9 may be a cylindrical container and has at the rear/on top a rearwardly directed hook portion 11 which is hooked onto the body 5 at the top thereof such that the outer member 9 is held in a forwardly directed position in relation thereto.

The step feeding device 4 includes an operating means 12 which is designed as a trigger and which is pivotally mounted on the body 5 through an axle 13. Lower portions 14 of the operating means 12 beneath the axle 13 are located in front of the handle member 6 and upper portions 15 above the axle 13 are located in the body 5 behind the outer member 9. Between the lower portions 14 of the operating means 12 and the handle member 6 there is provided a return spring 16, e.g. a helical spring, which is tensioned when said lower portions 14 are pressed backwards with the hand towards the handle member 6, i.e. when an operator conducts intermittent feeding movements in a discharge direction M at which the lower portions 14 move backwards and consequently, the upper portions 15 move forwards. When the pressure with the hand is released, the return spring 16 moves the operating means 12 in a return direction R which is opposite to the discharge direction M and which means that the lower portions 14 move forwards and the upper portions 15 backwards.

On the upper portions 15 of the handle member 6 there is provided an axle 17 on which there is located a step feeding means 18 which is adapted to transfer the feeding movements of the operating means 12 to a piston means 19 forming part of the step feeding device 4 and including a tooth rack 20 having backwardly directed teeth 21 and 22 respectively, on the underside and upperside respectively, and with two opposite sides without teeth. The tooth rack 20 also has a piston disc 23 on its front end portion.

Figure 5:
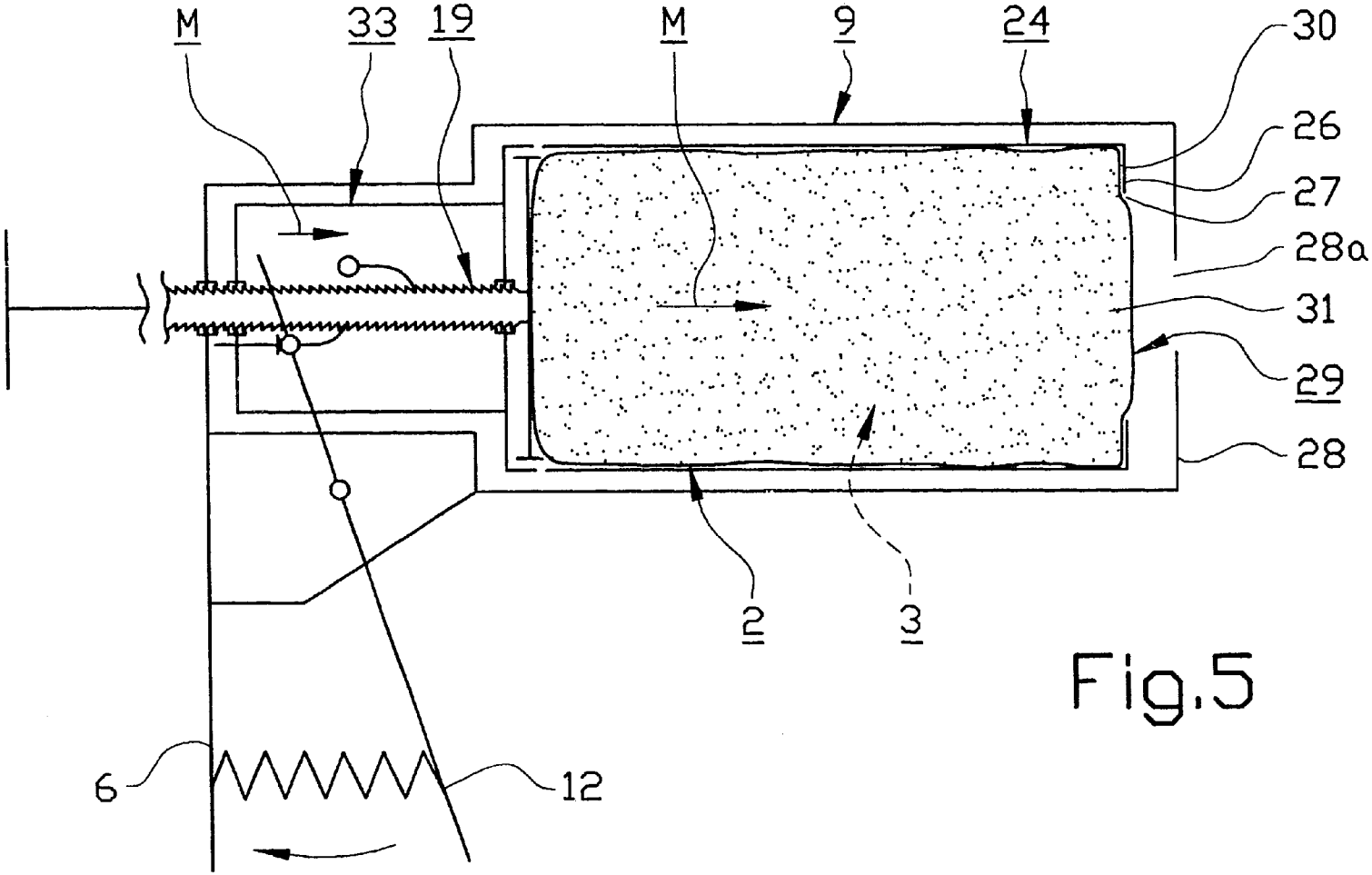
FIG. 5 illustrates schematically various parts of the discharge device of FIG. 1 in start positions.

An inner container 24 is provided in the outer member 9. The inner container 24 has a somewhat smaller outer diameter than the inner diameter of the outer member 9 and it has such a length that it is movable forwards/backwards in axial direction, i.e. in the feeding direction M and in the return direction R, relative to the outer member 9. The length of the inner container 24 is chosen such that it is movable e.g. 3–5 mm in said direction. The inner container 24 has an open rear end side 25 and a front end side 26 with a central opening 27. It can be located in a forward position FL (see FIG. 5) in which its front end side 26 is in contact with a front end side 28 of the outer member 9. Said latter front end side 28 on the outer member 9 has a central opening 28*a* which is substantially smaller than the opening 27 in front end side 26 of the inner container 24.

When full, the package 2 can be placed in the inner container 24 and it is sized such that it in this filled condition fills the entire inner container 24 or at least the major part thereof. The package 2 has front parts 29, the outer portions 30 of which are in contact with front end side 26 of the inner container 24 and the inner portions 31 of which are adapted to lie in or adjacent the opening 27 in the inner container 24. Said inner portions 31 are provided with at least one, preferably more discharge openings 32 which can be defined by cuts made cross-wise through the wall material of the package 2. Said inner portions 31 are also adapted to be in contact with the front end side 28 of the outer member 9 and the discharge openings 32 shall then be situated at the opening 28*a* in said front end side 28.

In the body 5 there is also provided a draw-back device 33 which as the inner container 24 is movable in axial direction, i.e. in the discharge direction M and in the return direction R, relative to the body 5 and the outer member 9. This draw-back device 33 has a front member 34 which is provided within a rear end side 35 of the outer member 9 and which includes a cylindrical outer member 36. This latter member has an outer diameter which is somewhat smaller than the inner diameter of the outer member 9 and which corresponds or substantially corresponds with the outer diameter of the inner container 24. Between opposing portions of the cylindrical outer member 36 there are provided two members 37, 38 which are-resilient in radial direction and which have such frictional contact with the tooth rack 20 of the piston means 19 that the draw-back device 33 from a rear or backward position (shown in FIG. 2) is brought to move along with the piston means 19 when said piston means is displaced in the discharge direction M. The resilient members 37, 38 are in contact with the opposite sides without teeth of the tooth rack 20 and they engage with pressure these sides without teeth.

The draw-back device 33 also includes rear members 39 which are located substantially behind the rear end side 35 of the outer member 9 and which extend to the front member 34 through an opening 40 in said rear end side 35. The rear members 39 of the draw-back device 33 have a support member 41 which is reached by the axle 17 of the operating means 12 or another part of the operating means 12 when said operating means is brought to carry out a return movement. When this happens, the upper portions 15 of the operating means 12 move the step feeding means 18 provided thereon backwards in a return direction R relative to the tooth rack 20 and this snaps in behind a tooth farther back on said tooth rack 20. Then, the axle 17 for the step feeding means 18 engages the support member 41 of the draw-back device 33 and displaces said draw-back device 33 backwards. This backward movement of the draw-back device 33 is transferred through its frictional contact to the tooth rack 20 until the support member 41 engages parts or members of the body 5 behind said support member 41. The support member 41 may be a set screw which is adjustable in the discharge direction M. The rear members 39 of the draw-back device 33 may include a resilient tongue 42 which is in contact with the step feeding means 18 and pushes it towards the teeth rack 20 such that said step feeding means 18 cooperates with the teeth 21. Said rear members 39 may also include a bracket 43 for a stop means 44, e.g. of spring steel or a corresponding resilient material. The stop means 44 may be in contact with the teeth 22 of the tooth rack 20 and allows the piston means 19 to move in the discharge direction M relative to the draw-back device 33, but prevents the piston means 19 from moving in the return direction R relative to said draw-back device 33. This is done while the stop means 44 snaps over and in behind the teeth 22 when the piston means 19 is moving in the discharge direction M. The rear members 39 of the draw-back device 33 eventually include a resilient tongue 42*a* having contact with the stop means 44 and pressing it towards the tooth rack 20 such that said stop means 44 cooperates with the teeth 22. The piston means 19 is rotatably mounted in the draw-back device 33 for permitting setting in a position in which its sides without teeth are directed towards the step feeding means 18 and stop means 44. When the piston means 19 is brought into this position, it can be withdrawn in the return direction R to a rear position in which its piston disc 23 is situated at least partly in the front member 34 of the draw-back device 33.

Figure 2:
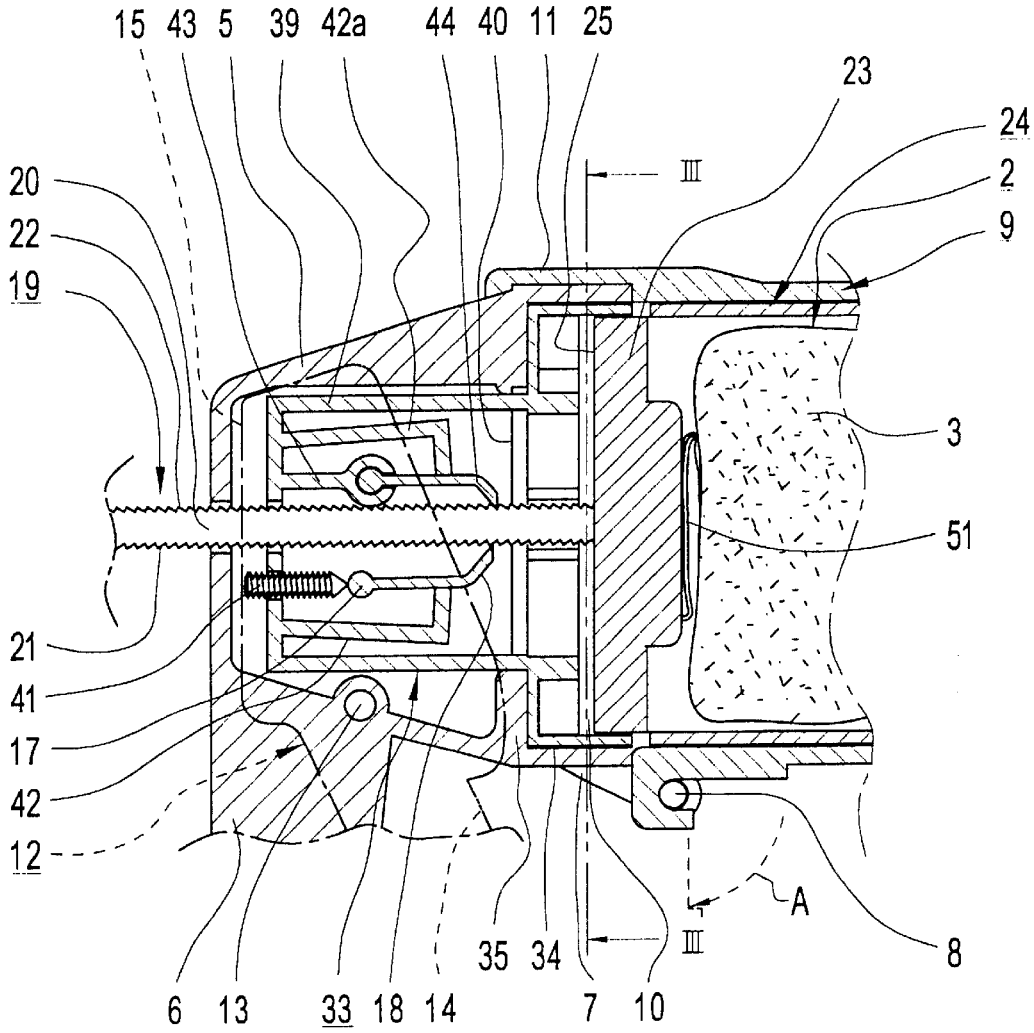
FIG. 2 is a vertical section through a rear portion of the discharge device of FIG. 1.
Figure 3:
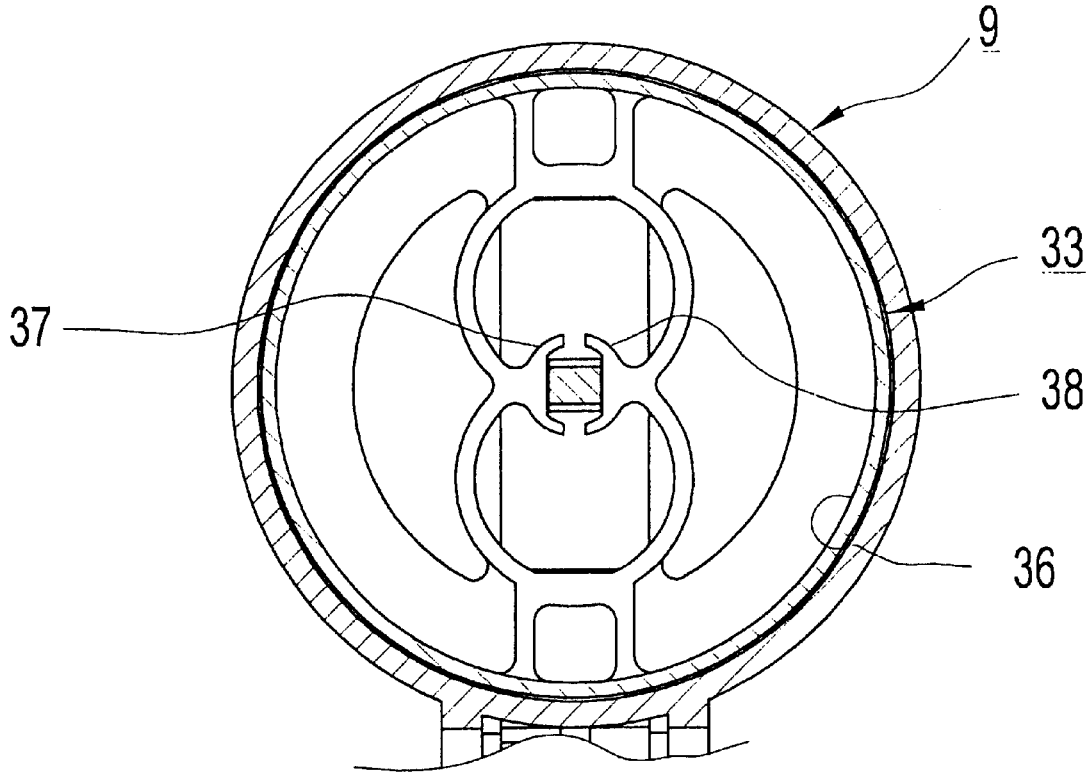
FIG. 3 is a section along the line III—III through the rear portion of the discharge device of FIG. 2.
Figure 4:
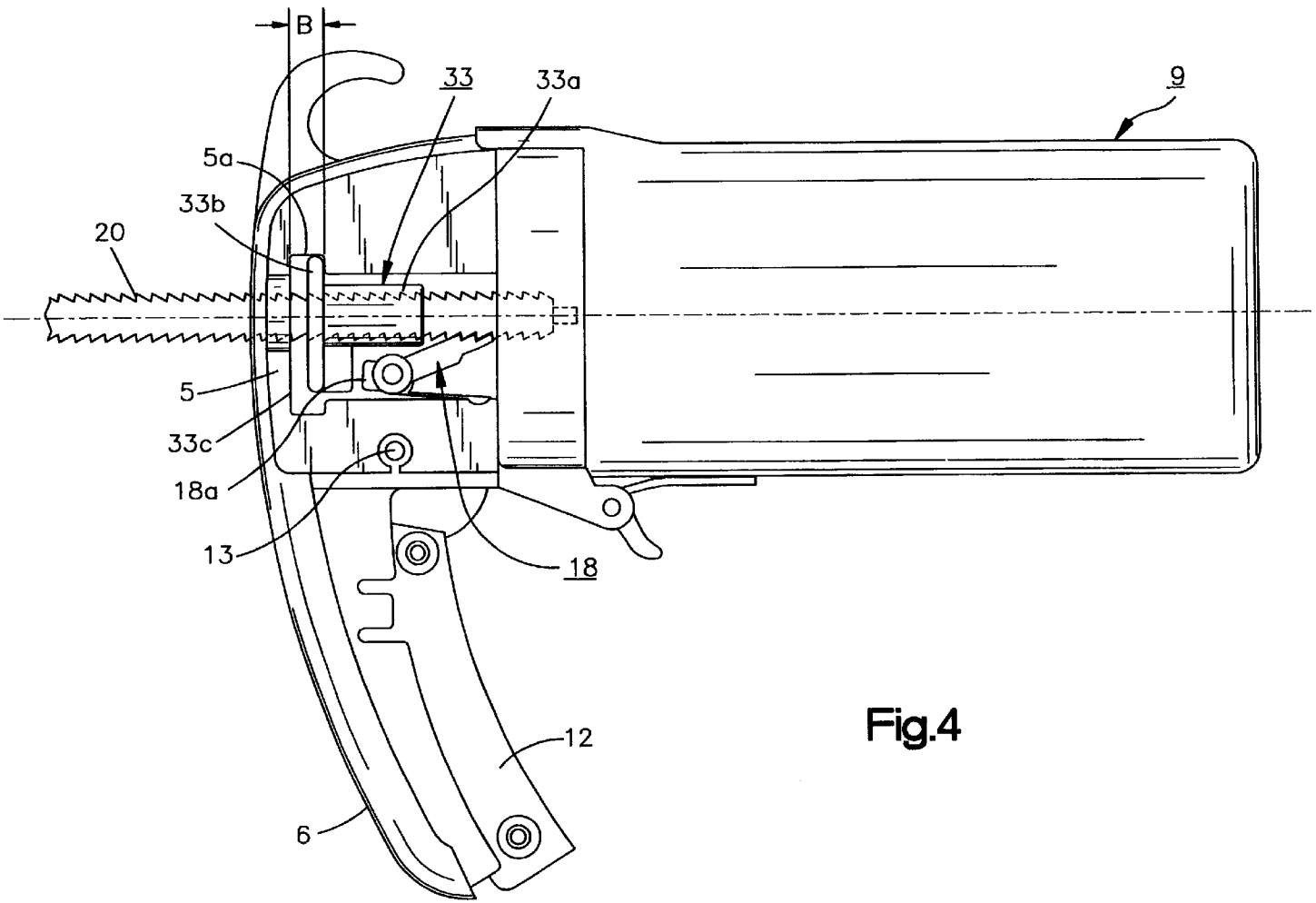
FIG. 4 is a side view of an alternative embodiment of the discharge device according to the invention.

FIG. 4 shows a second embodiment in which the draw-back device 33 and a few other, members in the discharge device 1 are designed in another way as in the first embodiment according to FIGS. 1 and 2, but the reference numerals on the members of the first embodiment are substantially maintained in the second embodiment.

At the embodiment of FIG. 4, the draw-back device 33 consists of a sleeve 33*a* which is threaded onto the tooth rack 20 and which is in frictional contact with the sides without teeth of the tooth rack 20. The sleeve 33*a* has an upper shoulder 33*b* at the back. The upper shoulder 33*b* engages a groove 5*a* in the body 5 and the width B of said groove 5*a* determines how far the draw-back device 33 can move. The lower shoulder 33*c* is adapted to cooperate with a rear shoulder 18*a* on the step feeding means 18.

In the position illustrated in FIG. 4, the operating means 12 is completely impressed after discharge of product 3 from the package 2. The draw-back device 33 has, because of its frictional contact with the tooth rack 20, followed said tooth rack 20 to a front or forward position When the operating means 12 is released, it will be pressed forward by the return spring 16, whereby its upper portions 15 move backwards. This means that the step feeding means 18 provided on said upper portions 15 moved backwards relative to the tooth rack 20 and snaps in behind a tooth farther back on the tooth rack 20. Thereafter, the rear shoulder 18*a* on the step feeding means 18 engages the lower shoulder 33*c* on the draw-back device 33 and pushes said device 33 backwards. This backward movement of the draw-back device 33 is transferred through its frictional contact with the tooth rack 20 which thus, is pulled backwards. The extent of the backward movement of the draw-back device 33 and the tooth rack 20 is determined by the width B of the groove 5*a* and when the draw-back device 33 has moved to its rear or backward position, the operating means 12 has moved to its front or forward position such that a new discharge operation can be carried through.

When the piston means 19 is affected in the discharge direction M, the draw-back device 33 is brought to move therewith, because of its frictional contact with said piston means 19, to a front or forward position.

Figure 11:
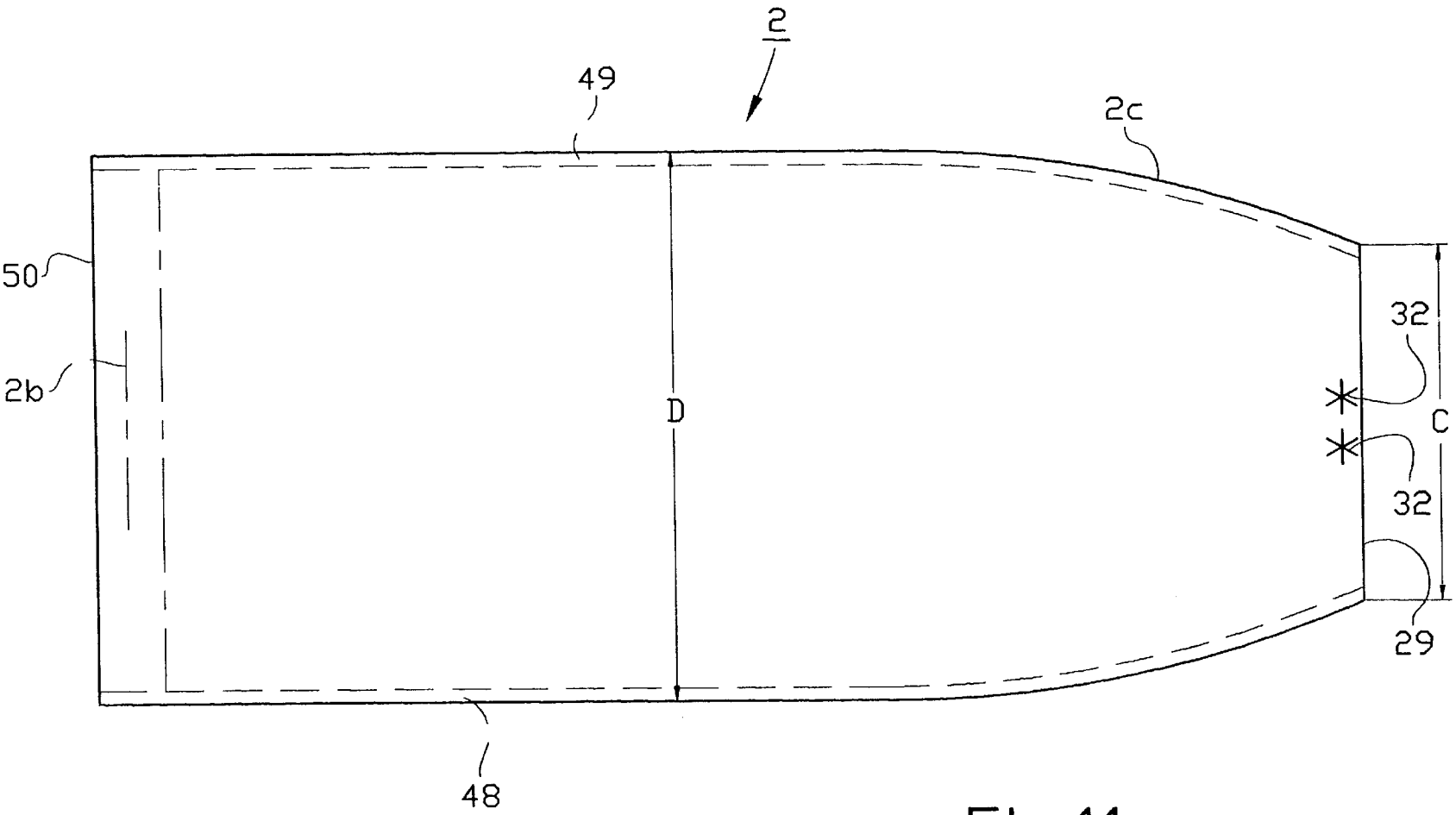
FIG. 11 is a plan view of an empty package which can be used in connection with the discharge device of FIG. 1 or 4.

The size and shape of the package 2 is, as noted above, adapted to the size and shape of the inner container 24, such that the package 2 along with its content preferably fills the entire inner container or at least substantial parts thereof. In FIG. 11, the package 2 is shown in empty and flat condition. It consists of a flexible wall material, preferably a thin plastic material, which is folded into two opposing wall portions 46, 47. One of the wall portions 46 transforms into the other wall portion 47 through a convex fold which defines the front parts 29 of the package 2, and along longitudinal sides 48, 49 said wall portions 46, 47 are closely sealed to each other, preferably by means of a heat sealing.

The package 2 has the form of a hose-like plastic bag which when not filled has an open transverse rear side 50. This transverse rear side 50 is closed after filling of the package 2 by sealing, preferably heat sealing, the opposing walls 46, 47 to each other along said rear side 50.

The rear parts 2*a* of the package 2 have a width D which is larger than the width C of the front parts 29 and the transition part 2*c* between the front and rear parts 29, 2*a* increases gradually in width in backward direction. Due to this shape the package 2 is easier to insert into the inner container 24.

In the front parts 29 of the package 2 one or more discharge openings 32 are provided to discharge product 3 present in the package 2. This package 2 forms a flexible plastic bag and its transverse rear side 50 may have an opening 2*b* for a bracket 51 on the piston disc 23 of the piston means 19. By inserting the bracket 51 in the opening 2*b*, the package 2 can be attached to the piston disc 23.

Figure 6:
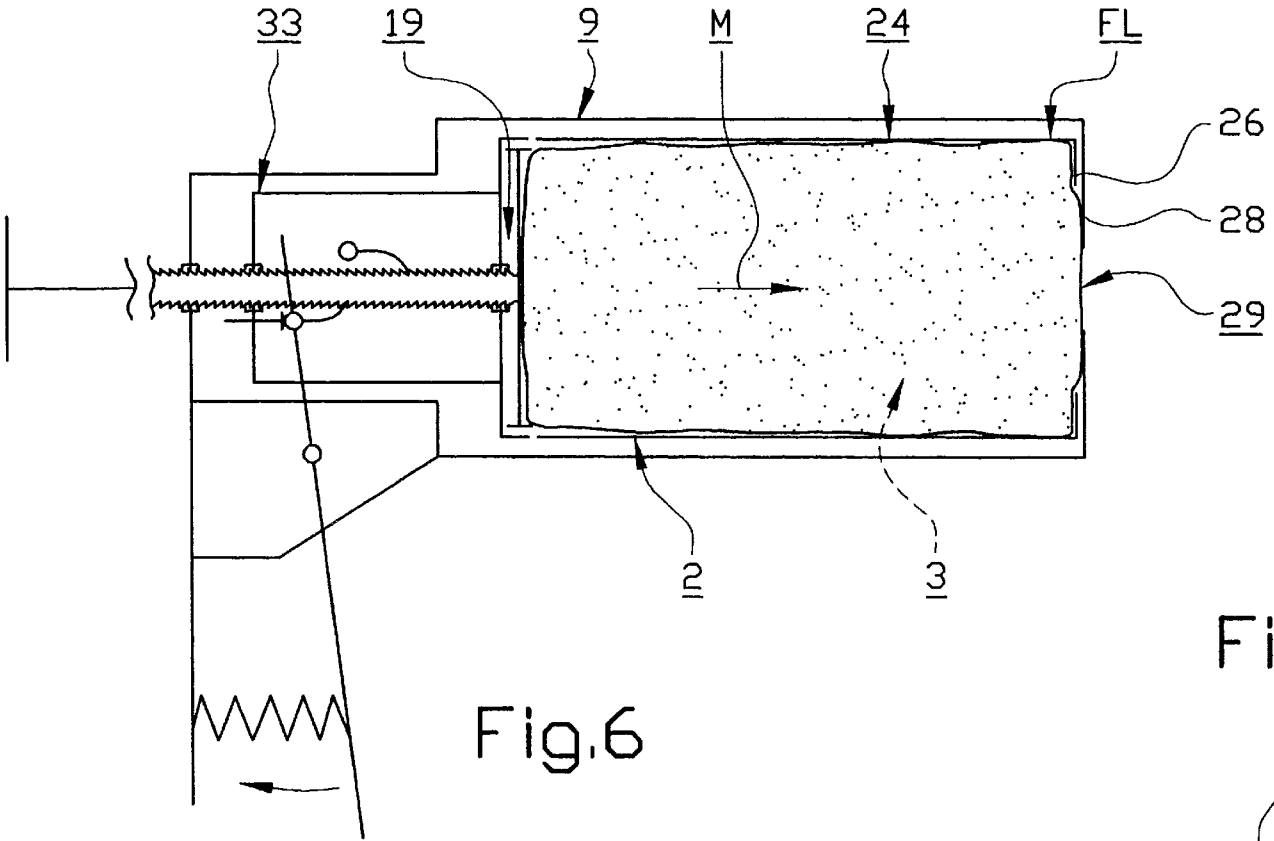
FIG. 6 illustrates schematically said various parts or members of the discharge device of FIG. 1 in changed positions after an initial discharge movement.
Figure 6A:
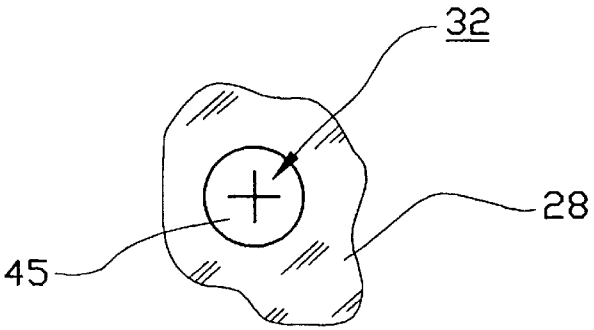
FIG. 6A illustrates a portion of a package placed in the discharge device of FIG. 1 and having a discharge opening closed.
Figure 7:
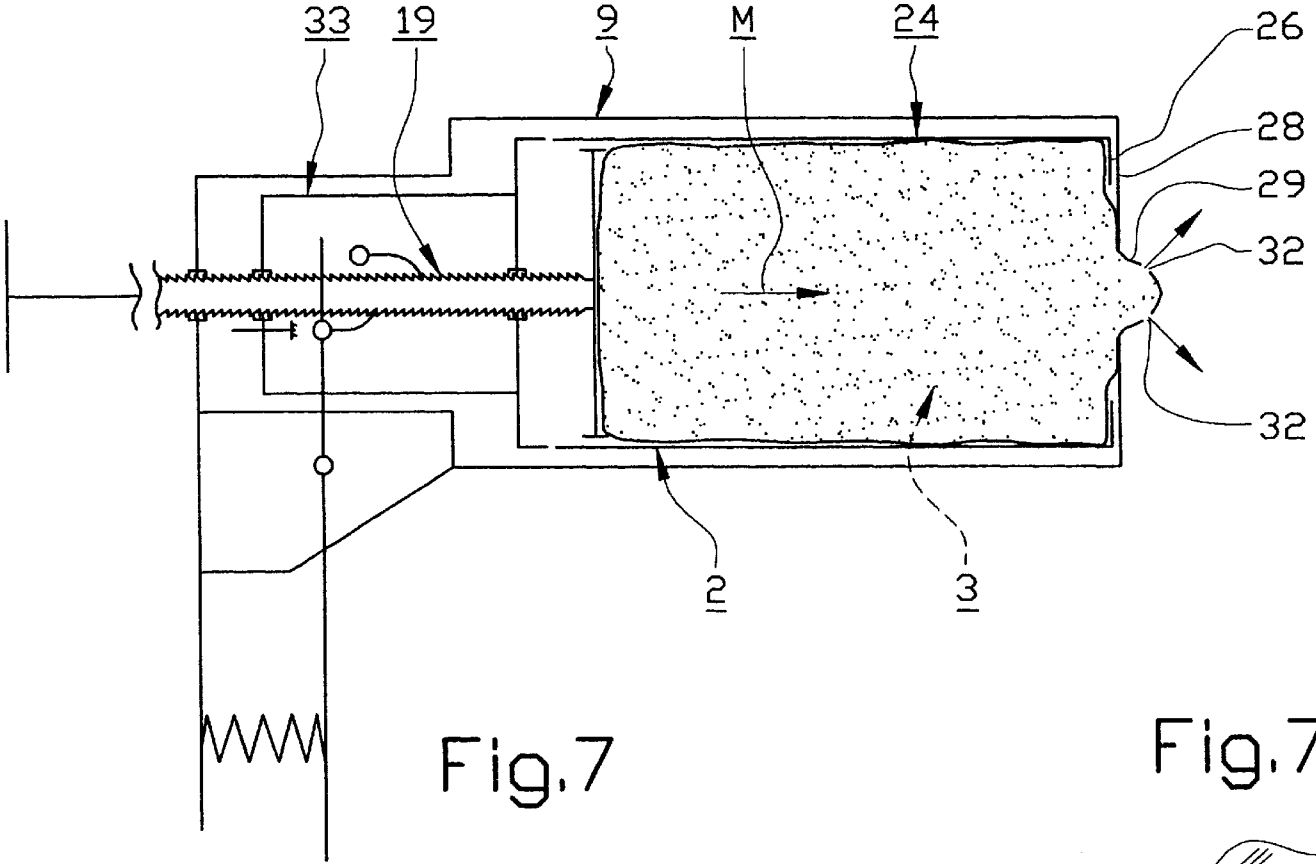
FIG. 7 illustrates schematically said parts or members of the discharge device of FIG. 1 in changes positions after a final discharge movement.
Figure 7A:
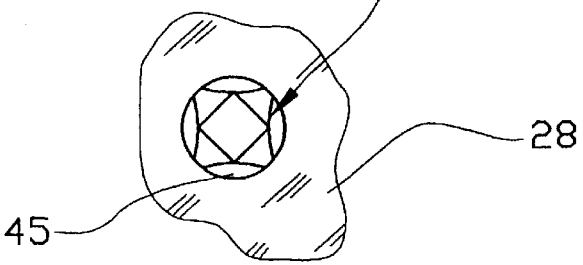
FIG. 7A illustrates the same portion of the package as in FIG. 6A with the discharge opening open.
Figure 8:
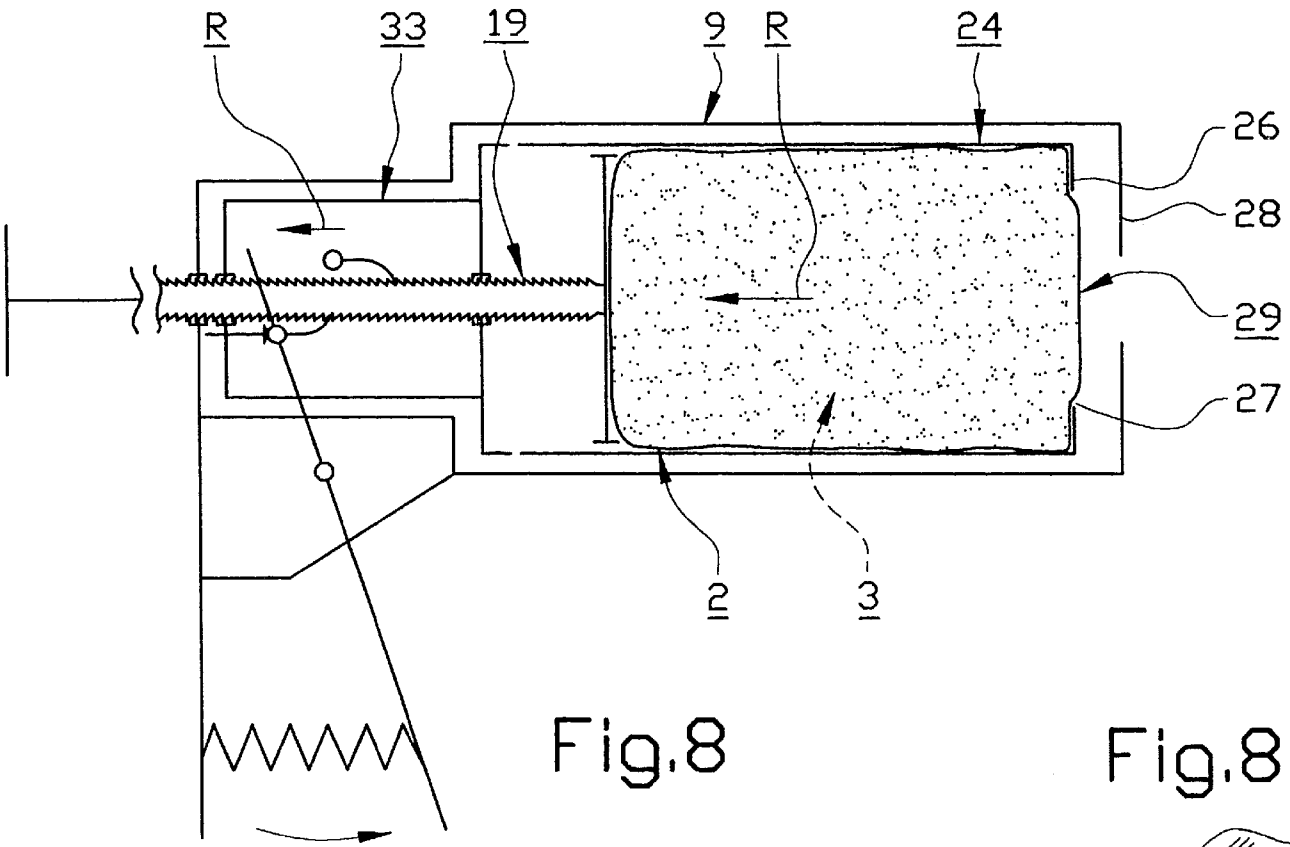
FIG. 8 illustrates schematically said various parts of the discharge device of FIG. 1 in changed positions after a return movement after the discharge movement.
Figure 8A:
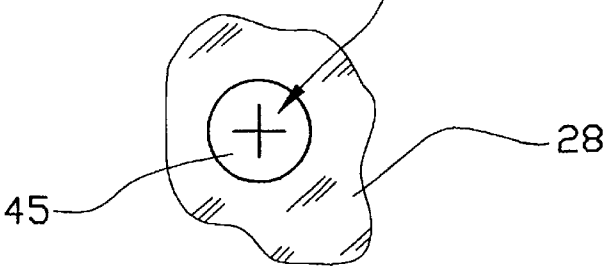
FIG. 8A illustrates the same portion of the package as in FIG. 7A with the discharge opening closed.
Figure 9:
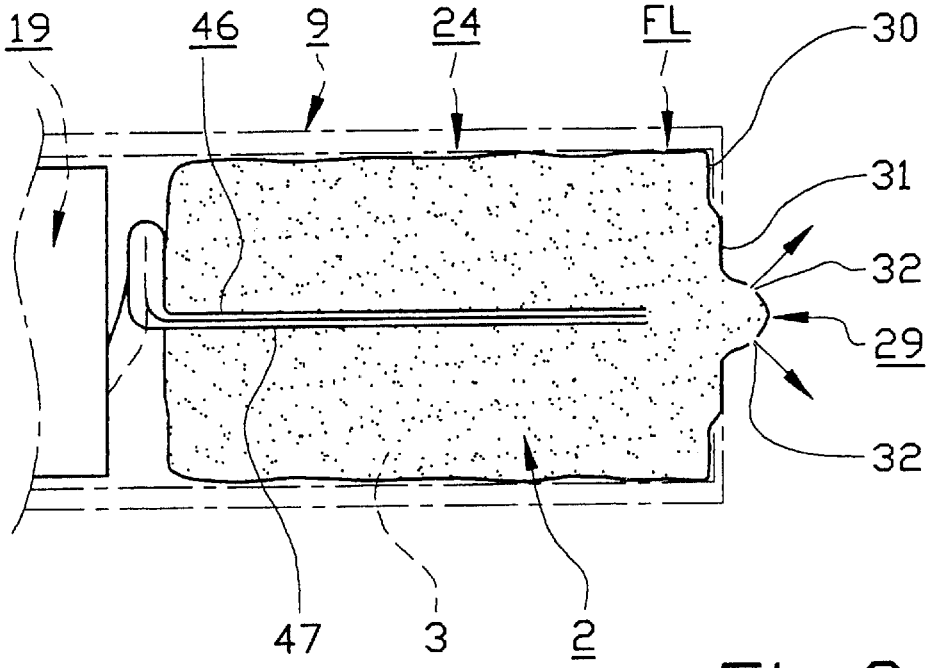
FIG. 9 is a side view of a full package used in connection with the discharge device of FIG. 1 or 4.
Figure 10:
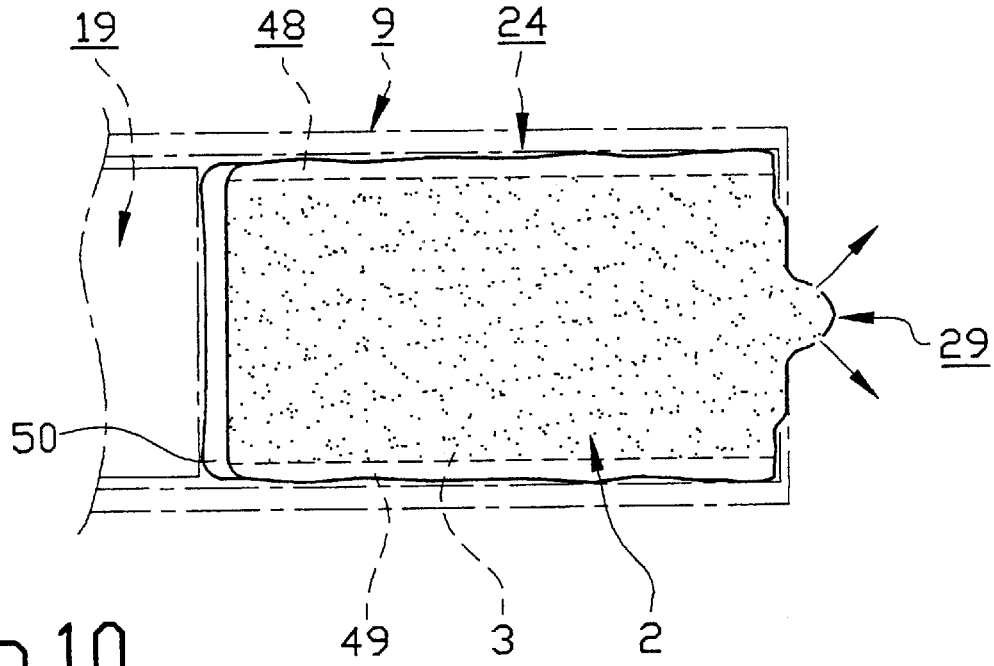
FIG. 10 is a plan view of the package of FIG. 9.

Every discharge opening 32 can be defined by two (or more) cuts crossing each other and can initially be closed (FIG. 6A). If pressure is applied onto the package 2 such that the product 3 therein press against it at the discharge opening 32, the wall material at the cuts will fold outwards and the discharge opening 32 will thereby open (FIG. 7A). When said pressure ceases, the wall material can eventually remain or return to its original shape at the cuts and the discharge opening 32 will thereby close again (FIG. 8A). This repeated closing of the discharge opening 32 however, is normally not necessary.

For discharge of product 3 from the package 2, the operating means 12 is pressed towards the handle member 6 (see FIG. 5) and is thereby imparted a movement which is transferred to the piston means 19 by the step feeding means 18 for imparting to said piston means 19 a discharge movement in a discharge direction M. During a first phase of its discharge movement in the discharge direction M, the piston means 19 will—because of the frictional connection between its tooth rack 20 and the draw-back device 33—displace the draw-back device 33 from a rear position in the discharge direction M, while simultaneously the piston means 19—because of the frictional contact between the piston disc 23 and the inside of the inner container 24—displaces the inner container 24 in the discharge direction M. During this displacement of the draw-back device 33 and the inner container 24, the outer portions 30 of the front parts 29 of the package 2 will engage the front end side 26 of the inner container 24, and the displacement will continue until the inner container 24 has reached the front position FL, whereby the inner portions 31 of the front parts 29 of the package 2 come in contact with the front end side 28 of the outer member 9 (FIG. 6). When the inner container 24 has reached said front position FL, the draw-back device 33 has also reached a front position and is prevented by the inner container 24 to proceed forward in the discharge direction M.

When the operating means 12 is pressed further towards the handle member 6 and the inner container 24 has been brought to its front or forward position FL and then can not move further in the discharge direction M, the frictional contact of the piston disc 23—because of the continued influence from the piston means 19 in the discharge direction M—with the inner container 24, will be overcome and thus, the piston means 19 will move in the discharge direction M relative to the inner container 24. The piston means 19 will thereby affect the package 2 in the discharge direction M such that said package is compressed, whereby the pressure on the product 3 therein increases. Hereby, the inner portions 31 of the front parts 29 will be stretched out through the opening 28*a* in the outer member 9 into a partly spherical shape. The portions having said shape might include several discharge openings 32 which are located such that they bring the product 3 to flow out in diverging directions.

When the operating means 12 is released, it is imparted a return movement (see FIG. 8) by means of the return spring 16 and when the inner container 24 with the package 2 begin to be withdrawn or pulled back in the return direction R, the inner portions 31 of the front parts 29 of the package 2 leave the front end side 28 of the outer member 9, whereby the discharge pressure on the product 3 and thereby, the discharge thereof, immediately ceases and dripping after discharge is prevented. Said inner portions 31 can preferably expand in forward direction through the opening 27 in the inner container 24 when the front parts 29 of the package 2 leave the front end side 28 of the outer member 9, whereby the feed-pressure reduction is facilitated or expedited.

After each step of feeding, the abovementioned procedure will be repeated until the package 2 is empty, which means that after-discharge is effectively prevented during all steps of the discharge procedure.

The invention is not limited to what is described above and illustrated in the drawings, but may vary within the scope of the subsequent claims. Thus, the package 2 may be completely compressible by the piston means 19. The piston means 19 of the feeding device 4 may cooperate with the inner container 24 in other ways than by frictional contact and the return movement R is obtained by other means than by the piston means 19, whereby the draw-back device 33 may be replaced by said other means.

What is claimed is:

1. Device for discharge of a viscous product from a package of flexible material, wherein the discharge device (1) comprises an outer member (9) and an inner container (24) provided in said outer member, said package (2) with the product (3) to be discharged being located in said inner container, wherein a feeding device (4) is provided to displace the inner container (24) with the package (2) provided therein in a discharge direction (M) to a front or forward position (FL) relative to the outer member (9), whereby, in said front or forward position (FL), front parts (29) of the package (2) engage a front end side (28) of the outer member (9), wherein a piston means (19) forming part of the feeding device (4) is provided to compress the package (2) and thereby increase the pressure on the product (3) therein for discharge of said product when the front parts (29) of the package (2) in said front position (FL) engage the front end side (28) of the outer member (9), wherein the package (2) is provided in the inner container (24) such that they are displaced together in a return direction (R) from the front or forward position (FL), and wherein the package (2) is provided such that the discharge of the product (3) therefrom ceases when the pressure on the product (3) in the package (2) decreases, characterized in that the inner container (24) has a front end side (26) with an opening (27), that outer portions (30) of the front parts (29) of the package (2) are provided to engage the front end side (26) of the inner container (24), that inner portions (31) of the front parts (29) of the package (2) are provided to engage the front end side

(28) of the outer member (9) when the product (3) is discharged from the package (2), and that the opening (27) in the front end side (26) of the inner container (24) is larger than an opening (28*a* in the front end side (28) of the outer member (9).

2. Device according to claim 1, characterized in that the front parts (29) of the package (2) are provided to disengage the front end side (28) of the outer member (9) when said package (2) together with the inner container (24) is displaced in the return direction (R) from the front position (FL).

3. Device according to claim 1, characterized in that the front parts (29) of the package (2) are provided to expand when they disengage the front end side (28) of the outer member (9).

4. Device according to claim 1, characterized in that the inner container (24) engages the front end side (28) of the outer member (9) when the inner container (24) and the package (2) are situated in the front or forward position (FL).

5. Device according to claim 1, characterized in that the inner portions (31) of the front parts (29) of the package (2) have a plurality of discharge openings (32) which are provided such that the product (3) is brought to flow out, therethrough in diverging directions when said inner portions (31) are stretched through the opening (28*a*) in the front end side (28) of the outer member (9).

6. Device according to claim 1, wherein the feeding device (4) includes a piston means (19) for compressing the package (2) and thereby increase the pressure on the product (3) therein for discharge of said product (3) from the package (2), and wherein the piston means (19) is provided to displace the inner container (24) with the package (2) provided therein in the discharge direction (M), characterized in that the piston means (19) is provided through frictional contact with the inner container (24), to displace said inner container (24) and the package (2) located therein in the discharge and return directions (M and R), and that the frictional contact of the piston means (19) with the inner container (24) can be overcome when the front parts (29) of the package (2) engage the front end side (28) of the outer member (9) such that the piston means (19) can compress the package (2).

7. Device according to claim 6, characterized in that the inner container (24) consists of a flexible material and has an inner side with a circular cross section, that the piston means (19) has a non-circular shape and engages the inside of the inner container (24) at least three places, and that the piston means (19) has such a size that it presses out the inner container (24) in those places at which the piston means (19) engages said inner container (24).

8. Device according to claim 7, wherein the piston means (19) has a tooth rack (20) which through a step feeding means (18) is imparted feeding movements in a discharge direction (M), and wherein the step feeding means (18) is provided to move relative to the tooth rack (20) in order to snap in behind a tooth thereof lying farther back, characterized in that a draw-back device (33) has such a frictional contact with the tooth rack (20) that it follows said tooth rack (20) in the discharge direction (M) and can withdraw or pull back said tooth rack (20) in the return direction (R).

9. Device according to claim 6, characterized in that the piston means (19) comprises a bracket (51) for attachment of rear portions (50) of the package (2).

10. Package for use in connection with a device for discharge of a paste-like, viscous, product, e.g. mayonnaise or similar, from a package of flexible material, wherein the discharge device (1) comprises an outer member (9) and an inner container (24) provided in said outer member, said package (2) with the product (3) to be discharged being located in said inner container, wherein a feeding device (4) is provided to displace the inner container (24) with the package (2) provided therein in a discharge direction (M) to a front or forward position (FL) relative to the outer member (9), whereby, in said front or forward position (FL), front parts (29) of the package (2) engage a front end side (28) of the outer member (9), and wherein a piston means (19) forming part of the feeding device (4) is provided to compress the package (2) and thereby increase the pressure on the product (3) therein for discharge of said product when the front parts (29) of the package (2) in said front position (FL) engage the front end side (28) of the outer member (9), characterized in that the front parts (29) of the package (2) are provided with outer portions (30) which are provided to engage a front end side (26) of the inner container (24) around an opening (27) in said front end side (26), and that inner portions (31) of the front parts (29) of the package (2) can be stretched or expanded through the opening (28*a*) in the front end side (28) of the outer member (9) when the piston means (19) is moved in the discharge direction (M) such that at lest one opening (32) in said front parts (29) of the package (2) is opened in order to admit discharging of the product (3) from the package (2).

11. Package for use in connection with a device for discharge of a viscous product from a package of flexible material, wherein the discharge device (1) comprises an outer member (9) and an inner container (24) provided in said outer member, said package (2) with the product (3) to be discharged being located in said inner container, wherein a feeding device (4) is provided to displace the inner container (24) with the package (2) provided therein in a discharge direction (M) to a front or forward position (FL) relative to the outer member (9), whereby, in said front or forward position (FL), front parts (29) of the package (2) engage a front end side (28) of the outer member (9), and wherein a piston means (19) forming part of the feeding device (4) is provided to compress the package (2) and thereby increase the pressure on the product (3) therein for discharge of said product when the front parts (29) of the package (2) in said front position (FL) engage the front end side (28) of the outer member (9), characterized in that the front parts (29) of the package (2) are provided with outer portions (30) which are provided to engage a front end side (26) of the inner container (24) around an opening (27) in said front end side (26), and that the front parts (29) of the package (2) are provided with inner portions (31) which are provided to engage the front end side (28) of the outer member (9) when the product (3) is discharged from the package (2).

12. Package according to claim 10, characterized in that the front parts (29) of the package (2) are designed such that when the package (2) together with the inner container (24) is moved in the return direction (R) from the front or forward position (FL), the pressure on the product (3) in the package (2) decreases and the discharge thereof from said package (2) ceases.

13. Package according to claim 10, characterized in that the package (2) has front parts (29) which can expand when they disengage the front end side (28) of the outer member (9).

14. Package according to claim 13, characterized in that the front parts (29) of the package (2) can expand through an opening (27) in a front end side (26) of the inner container (24).

15. Package according to claim 10, characterized in that the package (2) has front parts (29) which can be expanded or stretched through an opening (28*a*) in a front end side (28) of the outer member (9).

16. Package according to claim 15, characterized in that the front parts (29) of the package (2) can be stretched or expanded to a partly spherical shape, and that the front parts (29) of partly spherical shape have a plurality of discharge openings which are provided such that they bring the product (3) to flow out therethrough in diverging directions.

17. Package according to claim 10, characterized in that the package (2) consists of a flexible wall material which is folded into two opposing wall portions (46, 47), whereby folded portions of the wall material, through which one of the wall portions (46) transforms into the other wall portion (47), define the front parts (29) of the package (2).

18. Package according to claim 17, characterized in that said folded parts (29) have a convex rounded shape.

19. Package according to claim 17, characterized in that the opposing wall portions (46, 47) of the package (2) are sealed, preferably heat sealed, to each other along longitudinal sides. (48, 49) of the package (2), that the package (2) has an open transverse rear side (50) through which the product (3) can be filled, and that the transverse rear side (50) can be closed by sealing, preferably heat sealing, the opposing wall portions (46, 47) to each other along said transverse rear side (50).

20. Package according to claim 10, characterized in that the width (D) of rear parts (2*a*) of the package (2), in empty condition, is larger than the width (C) of the front parts (29), and that the transition part (2*c*) of the package (2) between the front and rear parts (29, 2*a*) increases gradually in width in backward direction.

21. Package according to claim 10, characterized in that the package (2) includes a rear part (2*a*) with at least one opening (2*b*) for a bracket (51) through which the package (2) can be attached to the piston means (19).

22. Package according to claim 10, characterized in that the package is made of such flexible wall material that it is completely compressible by the piston means (19).

23. Package according to claim 10, characterized in that the package (2) is a plastic bag.

* * * * *